US007004424B1

(12) United States Patent
Pacchia

(10) Patent No.: US 7,004,424 B1
(45) Date of Patent: Feb. 28, 2006

(54) PROJECTILE FLIGHT ALTERING APPARATUS

(75) Inventor: Joseph Pacchia, Mountain Lakes, NJ (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 53 days.

(21) Appl. No.: 10/708,977

(22) Filed: Apr. 5, 2004

(51) Int. Cl.
*F42B 10/00* (2006.01)

(52) U.S. Cl. ..... 244/3.27; 244/3.26; 102/348; 102/400

(58) Field of Classification Search ..... 244/3.24, 244/3.26, 3.27, 3.28, 3.29; 102/348, 400
See application file for complete search history.

(56) References Cited

U.S. PATENT DOCUMENTS 6,511,016 B1 * 1/2003 Bär et al. ..... 244/3.24
6,727,485 B1 * 4/2004 Rastegar et al. ..... 244/3.1

* cited by examiner

*Primary Examiner*—J. Woodrow Eldred
(74) *Attorney, Agent, or Firm*—Robert Charles Beam; John F. Moran

(57) ABSTRACT

A mechanism to alter the flight path of a projectile after launch. A plurality of fins are disposed around the projectile and are held in place by one or more caging wires, depending on fin design. In one embodiment, auxiliary fins are connected to adjacent main fins which are held in a stowed position. When released, the fins deploy and present a continuous surface to the airstream for maximum braking action. In another embodiment, each fin is divided into fin segments which are individually deployable to alter the spin or course of the projectile by deflection. Additionally, all of the fins may be deployed to provide a braking action. All of the fins are tied together to distribute and reduce encountered loads when deployed.

11 Claims, 15 Drawing Sheets

PROJECTILE FLIGHT ALTERING APPARATUS

FEDERAL RESEARCH STATEMENT

The inventions described herein may be made, used, or licensed by or for the U.S. Government for U.S. Government purposes.

BACKGROUND OF INVENTION

It is often desired to modify the trajectory of a projectile (including missiles) after it has been fired. Conditions such as wind, temperature variations, precipitation, aiming error etc. can cause the projectile to deviate from its intended course, as determined by remote tracking of the projectile or on-board guidance systems. To modify the trajectory, mechanisms are used which are fit onto the projectile and deploy aerodynamic tabs, or fins, while in flight, to impart a corrective action to the projectile. Such corrective action may consist of braking, spin modulation and deflection of the projectile, each action being achieved by a single independent mechanism.

Such mechanisms utilize fins which pivot or eject from a closed inboard position to an open position whereby they extend radially around the projectile body. The pivoting means are subject to breakage when deployed into the airstream and in order to prevent such breakage the fins and pivots must be relatively massive and are typically of heavy machined metal. When deployed as a braking mechanism, the fins become spaced apart so as to present voids between fins, which require the fins to be larger to compensate for the voids. In one embodiment of the present invention an arrangement is provided which presents a continuous fin surface around the periphery of the projectile, with lightweight fins, to increase effective fin area and thus enhance braking action.

In other types of flight altering mechanisms, fins are deployed to spin modulate or deflect the projectile. They cannot, however, apply a braking action without deploying a second independent mechanism. In other embodiments of the present invention arrangements are provided that can selectively and sequentially accomplish spin modification, deflection, as well as braking as a final adjustment, if required.

SUMMARY OF INVENTION

A flight altering apparatus for attachment to a projectile, in accordance with the present invention, includes a frame member and a plurality of fins each connected to the frame member by a pivot and surrounding the projectile. A caging arrangement is provided to maintain the fins in a stowed condition and is operable, when activated, to allow deployment of the fins. A coupling means connects adjacent fins to evenly reduce and distribute aerodynamic loads on the fins and pivots when deployed, and ensure simultaneous and limiting deployment during the flight of the projectile.

BRIEF DESCRIPTION OF DRAWINGS

The invention will be better understood, and further objects, features and advantages thereof will become more apparent from the following description of the preferred embodiments, taken in conjunction with the accompanying drawings, in which.

DETAILED DESCRIPTION

Figure 1:
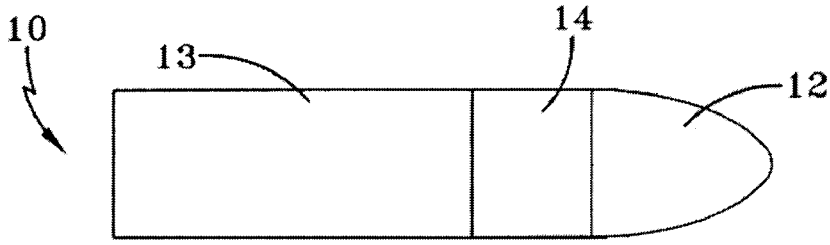
FIG. 1 depicts a projectile incorporating the apparatus of the present invention.

In the drawings, which are not necessarily to scale, like or corresponding parts are denoted by like or corresponding reference numerals.

FIG. 1 illustrates a projectile 10 having a forward removable portion 12 containing a fuze and an electronics section, and an aft portion 13 containing the cargo. The projectile 10 incorporates the present invention depicted as section 14. After the projectile 10 is fired it may be subject to deviation from its planned trajectory by such factors as wind, temperature variations, precipitation, aiming error and the like. In order to modify the trajectory, the fin deployable flight altering apparatus 14 is brought into play.

If the projectile 10 is being tracked by a remote tracking system, the electronics section of the forward portion 12 may receive commands from the tracking system to cause deployment of the fins. If the electronics section is self-contained with inertial guidance or GPS circuits, as well as a computer, then the electronics section itself may initiate deployment of the fins without external commands.

Figure 2:
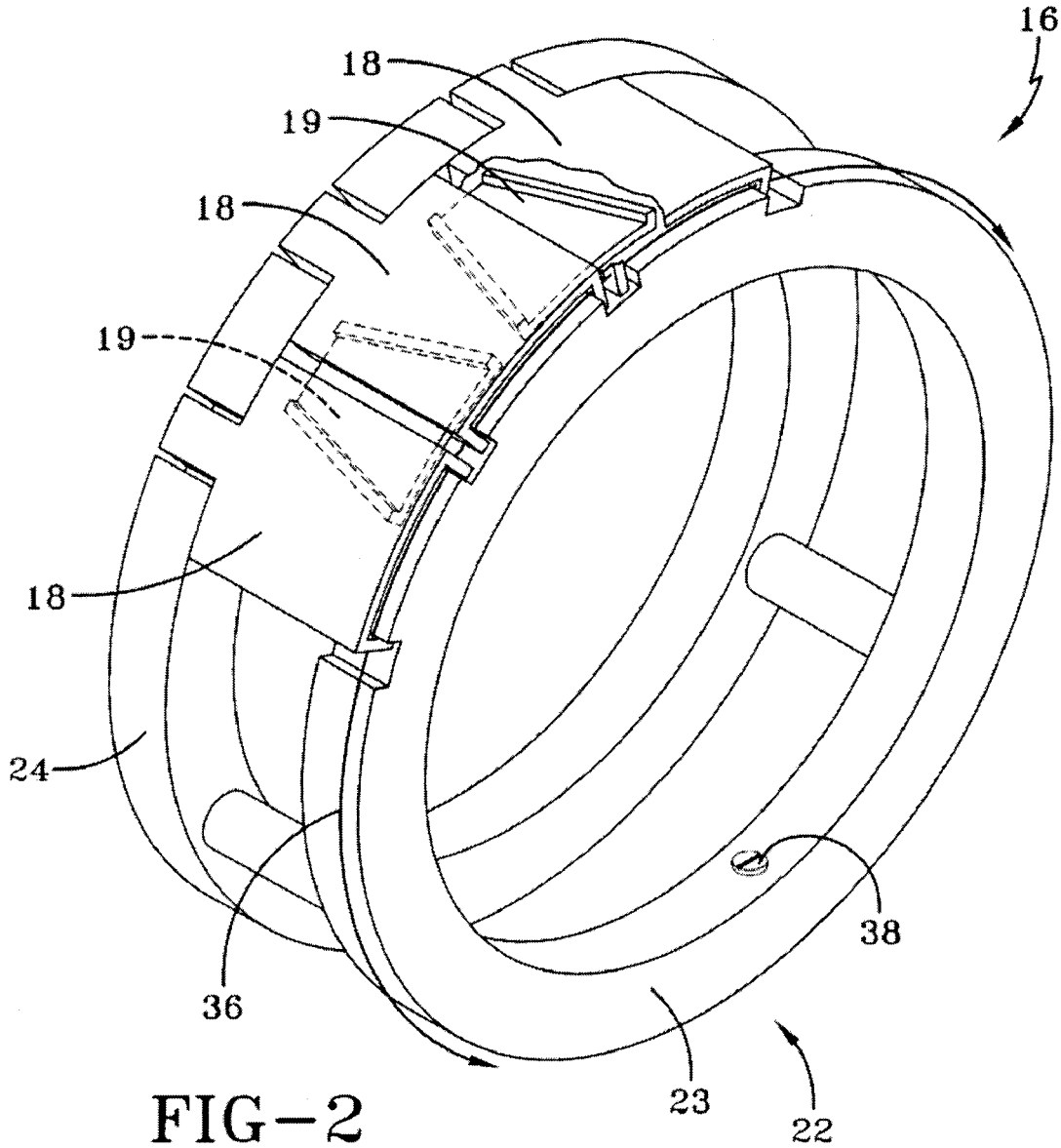
FIG. 2 is a view of a braking only embodiment of the present invention, in a closed and caged condition.
Figure 3:
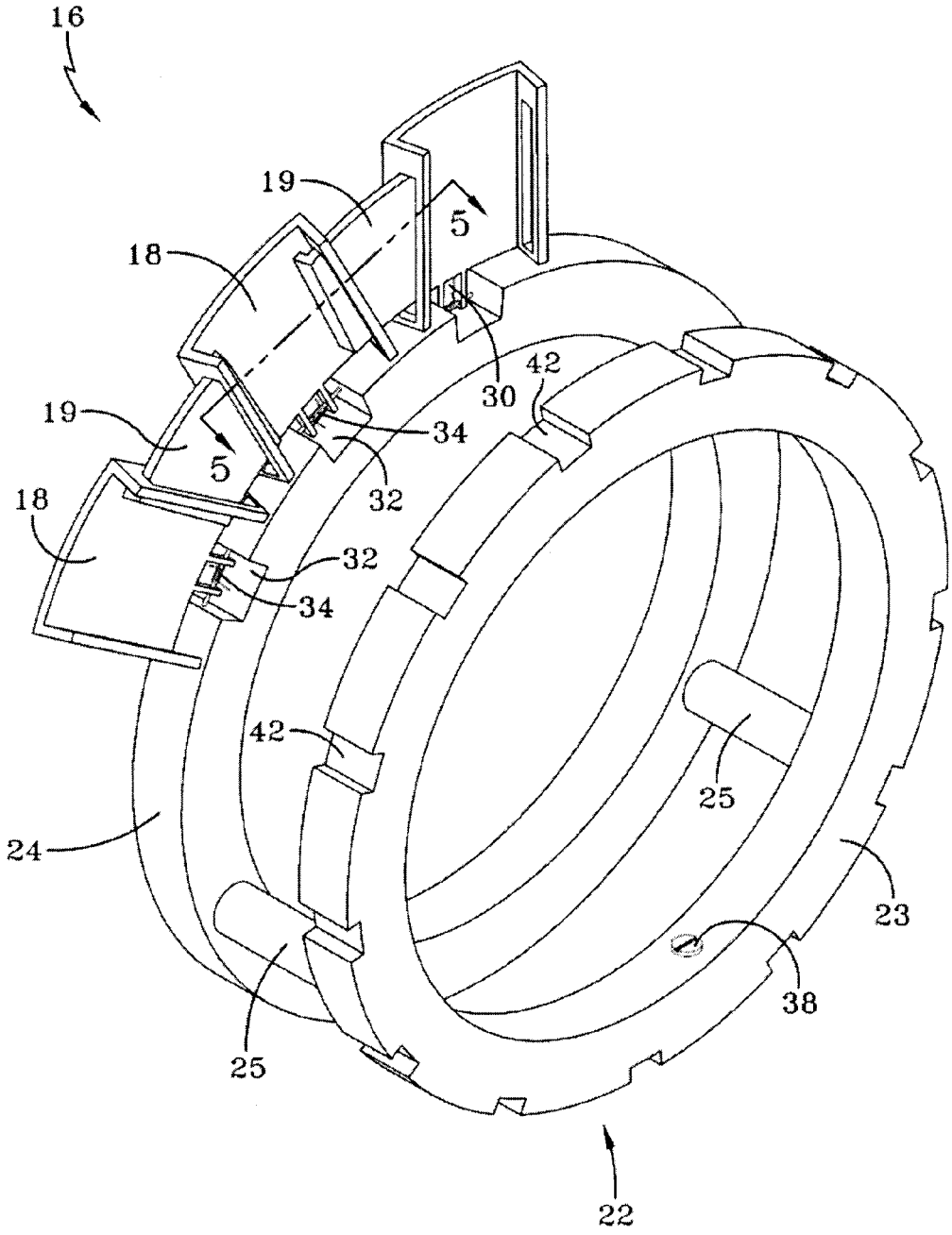
FIG. 3 is a view of the embodiment of FIG. 2, in an open deployed condition.

One embodiment of the present invention is illustrated in FIGS. 2 and 3 in a stowed and deployed condition, respectively. When stowed, as in FIG. 2, the fins are recessed to the airstream. The flight altering apparatus 16 of FIGS. 2 and 3 includes a plurality of main fins 18 and interconnecting auxiliary fins 19, such that when deployed, as in FIG. 3, the fins are tightly coupled together and present a fin surface to the airflow, which is continuous, and extends 360° around the projectile without any voids to create more drag and thus provide for a maximum braking action.

The fins are carried by a frame member 22, which, in FIGS. 2 and 3 takes the form of forward and aft rings 23 and 24, for simplicity, joined by spacers 25. In lieu of spacers 25, frame 22 may incorporate an aerodynamic shroud, allowing a continuous and smooth flow along the projectile. One end of each main fin 18 includes a tab 30 which is pivotally connected within a respective notch 32 in aft ring 24, and the arrangement preferably includes spring members 34 to initiate deployment into the airstream. The fins are maintained in a stowed, or undeployed, condition by a caging arrangement which, by way of example, may be a caging wire 36 threaded through all of the main fins 18 and connected to a tightening bolt 38 located in forward ring 23.

Figure 4:
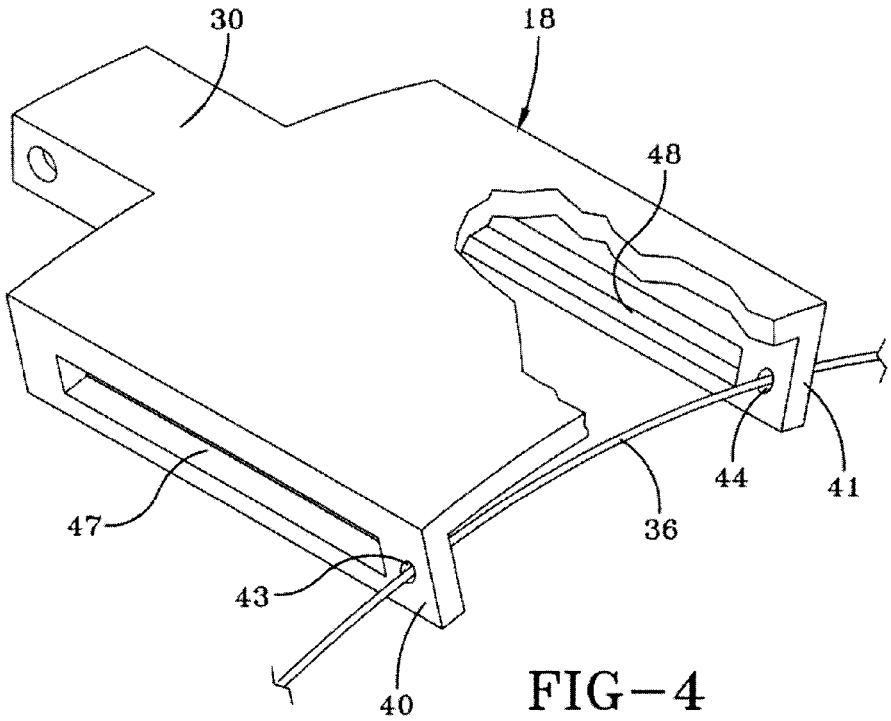
FIG. 4 illustrates a fin of FIG. 2.

A typical main fin 18, with a portion broken away, is illustrated in FIG. 4. Main fin 18 includes side flanges 40 and 41, which are accommodated by a series of notches 42 in forward ring 23 when in a stowed condition. Each flange 40 and 41 includes a respective aperture 43 and 44 through which the caging wire 36 is threaded. Side flanges 40 and 41 not only provided added strength to the fin but also include respective slots 47 and 48 to accommodate auxiliary fins 19. This may be seen in FIG. 5, which is a view along line 5—5 of FIG. 3.

Figure 5:
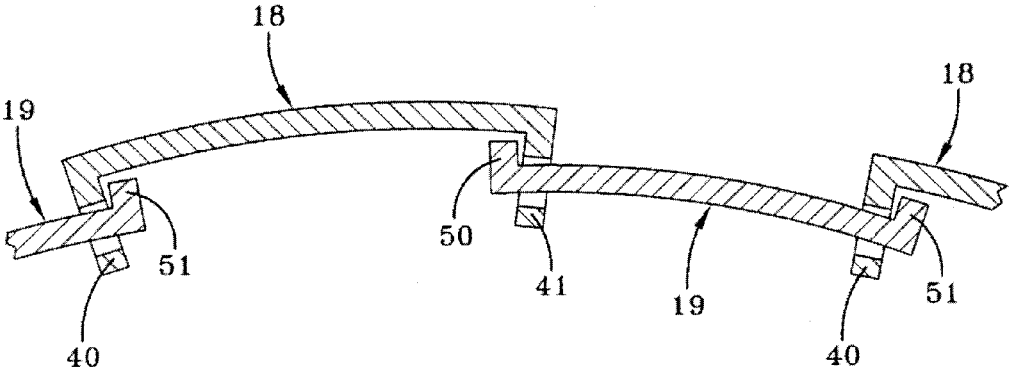
FIG. 5 is a view along line 5—5 of FIG. 3.

As seen in FIG. 5, auxiliary fins 19 include side flanges 50 and 51 of a dimension so as to fit into slots 48 and 47 in flanges 40 and 41 of adjacent main fins 18. A cutting device (not illustrated) such as a mechanical or pyrotechnic cutter may be disposed on the forward ring 23 and is operable, when commanded from the onboard electronics section of the projectile when in flight, to sever the caging wire 36, thus allowing springs 34 to cause deployment of main fins 18. Auxiliary fins 19 are slidable with respect to main fins 18 and when deployed, the flanges of main fins 18 and auxiliary fins 19 forcibly contact one another, as in FIG. 5, resulting in a uniform stress distribution 360° around the fins while reducing stress on the main fin pivots. In this regard it may be necessary that the fins deploy at an angle not to exceed 90° with respect to the central longitudinal axis of the projectile so as to not significantly reduce the maximum fin area to the airstream, while preventing the fin from engaging any pivot stops.

Figure 6:
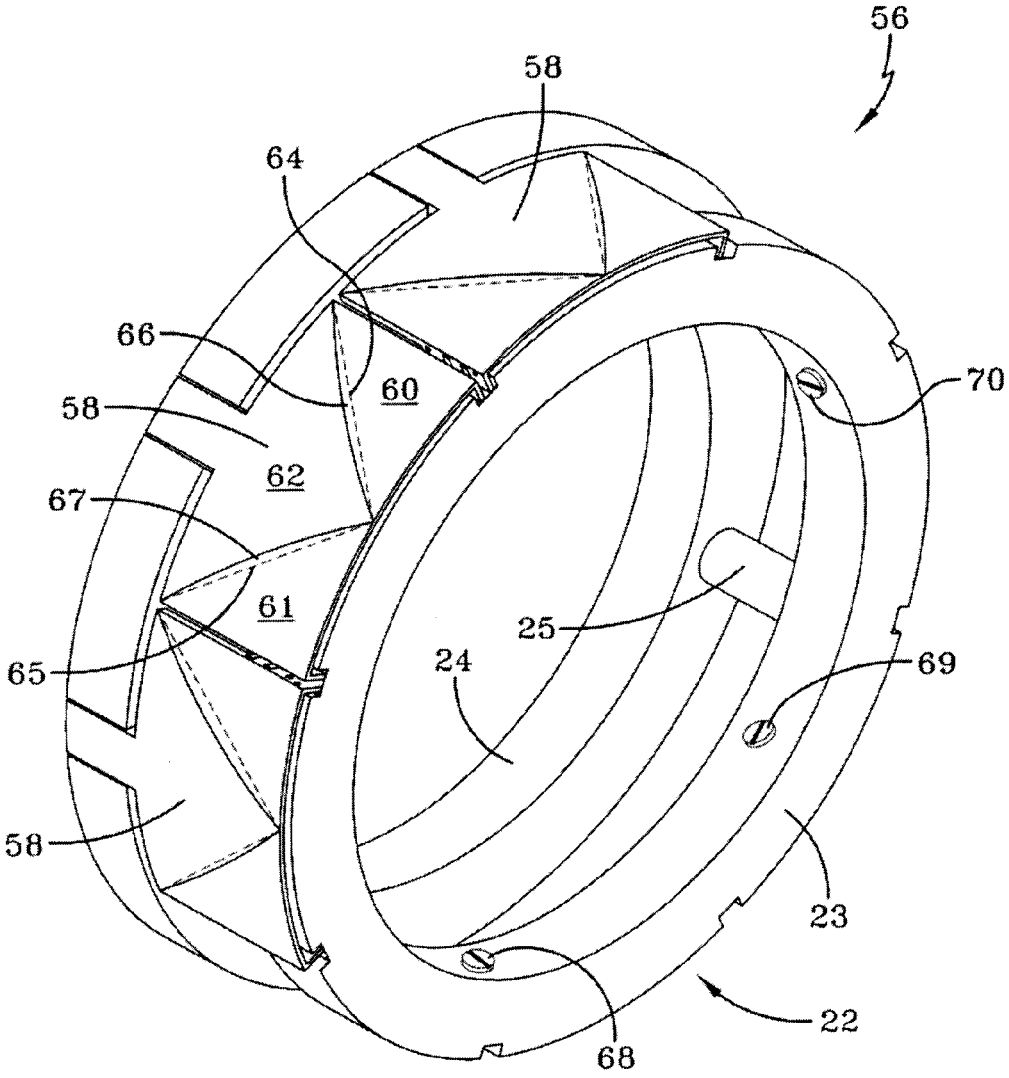
FIG. 6 illustrates a spin modulation and braking embodiment of the invention.

In FIG. 6, numeral 56 represents another embodiment of the flight altering apparatus of the present invention wherein fin segments are deployed to increase or decrease spin to the projectile in addition to braking. Frame 22 includes forward and aft rings 23 and 24 which accommodate a plurality of fins 58. Each fin 58 is divided into triangular fin segments 60 and 61 on either side of a central triangular segment 62, with fin segments 60 and 61 being pivotable about respective hinge lines 64 and 65. Hinge lines 64 and 65 may be actual elongated hinges or may be scored lines which effect bending between central segment 62 and segments 60 and 61. Due to the curvilinear shape of the fin 58 it is preferable that the fin include depressed areas 66 and 67 adjacent respective hinge lines 64 and 65 to ensure that these hinge lines are straight, so as to facilitate deployment. If eight planar fins are used in conjunction with an octagonal frame, such depressed areas would not be necessary.

Figure 7:
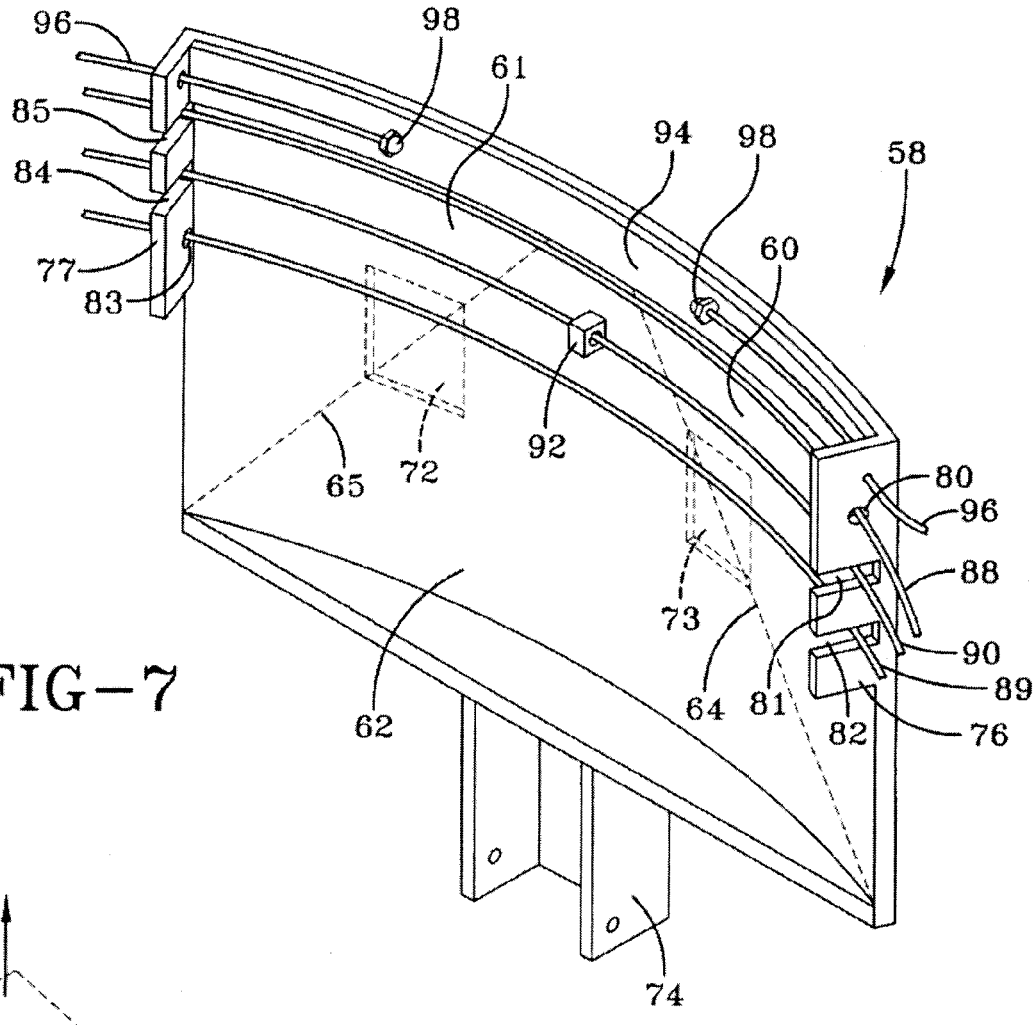
FIG. 7 illustrates a fin of FIG. 6.

As will be seen, the caging arrangement includes, for example, at least two, and preferably three caging wires connected to respective tightening bolts 68, 69 and 70 on forward ring 23. A more detailed view of the underside of a typical fin 58 is illustrated in FIG. 7. As an alternative to the depressed areas 66 and 67 on top of fin 58, thinned areas 72 and 73, (shown dotted) on the undersurface of fin 58 may accomplish the same result. Fin 58 includes a tab 74 which fits into a notch in aft ring 24 for pivotal movement about the ring, as in FIG. 3. Side flanges 76 and 77 include a series of notches and apertures located near the forward end of each fin 58. More particularly, side flange 76 includes an aperture 80 and two notches 81 and 82, while side flange 77 includes aperture 83 and notches 84 and 85.

Figure 8:
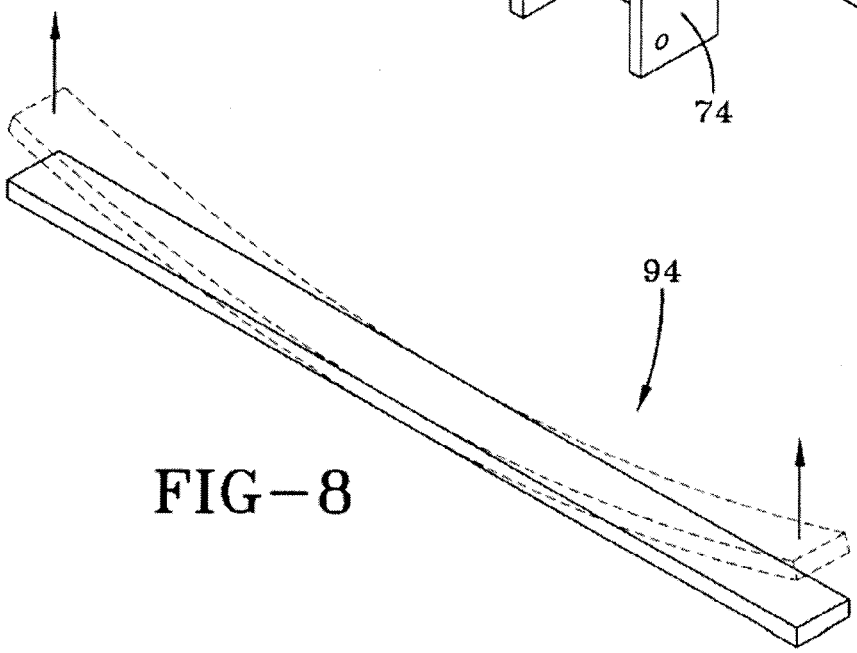
FIG. 8 is a spring member used on the fins of FIG. 7.

Caging wire 88 passes through notch 85 in side flange 77 and through aperture 80 in side flange 76 and secures fin segment 60 so that it will not deploy until caging wire 88 is released. Similarly, caging wire 89 passes through aperture 83 in side flange 77 and through notch 82 in side flange 76 and secures fin segment 61 so that it will not deploy until caging wire 89 is released. A caging wire 90 passes through an apertured stub 92 on the undersurface of central fin segment 62, and through notches 81 and 84 in side flanges 76 and 77. With this arrangement, either fin segment 60 or 61 may be selectively deployed, by releasing either caging wire 88 or 89. To assist in this deployment, and as indicated in FIG. 8, a naturally outboard curved leaf spring 94, shown dotted, may be secured to the underside of front edge of fin 58 where it will be held in the position shown solid. If all three caging wires 88, 89 and 90 are released, the entire fin 58 may be deployed. FIG. 7 additionally shows a wire 96 which is connected between fin segments of adjacent fins to serve as a coupling means to distribute loads and to limit the extent of deployment. The limiting of the extent of such deployment is governed by the stop members 98 at the ends of the wires 96. Selective deployment of a fin segment or the entire fin is illustrated in FIGS. 9 and 10, respectively.

Figure 9:
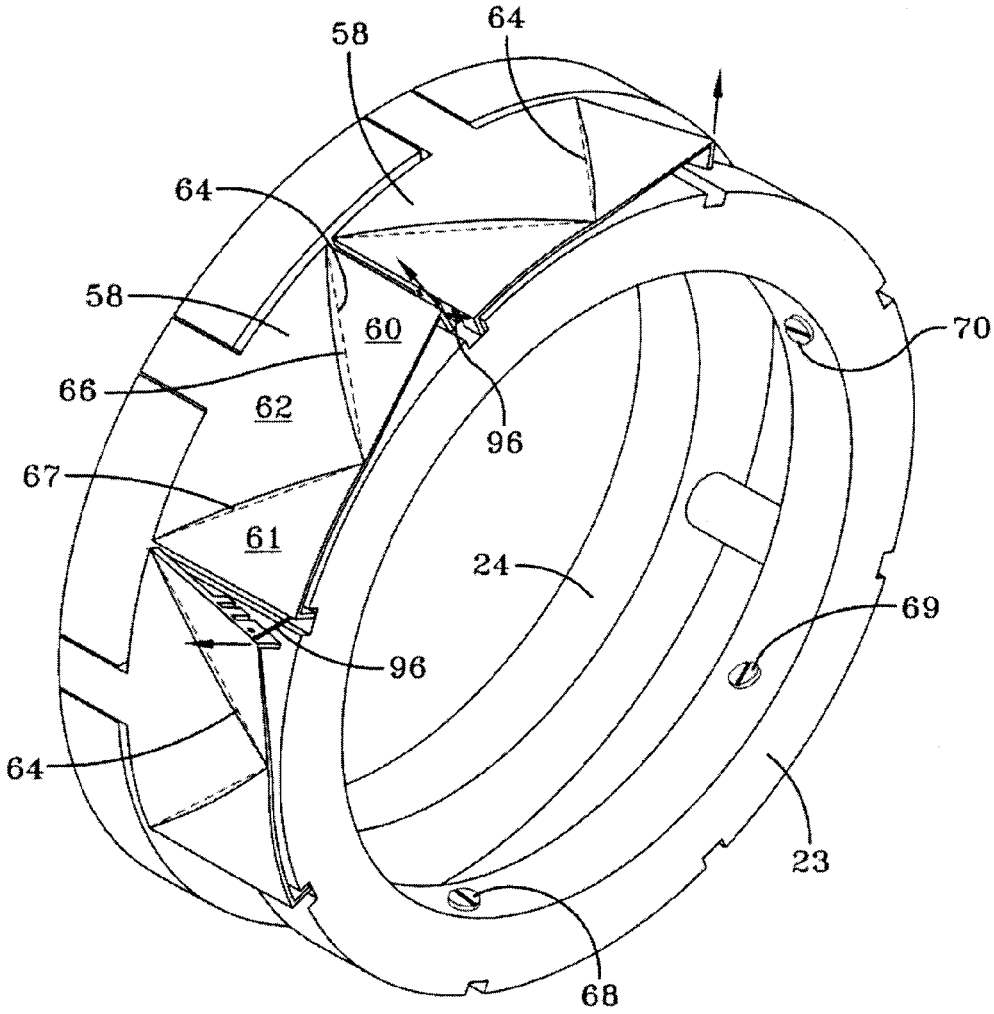
FIG. 9 illustrates fin deployment of the fins of FIG. 6 for modifying spin.

In FIG. 9 caging wire 88 (not illustrated for clarity) has been cut, releasing all fin segments 60 which pivot around hinge lines 64 to the position illustrated. When fin segments 60 are deployed, due to the aerodynamic forces involved, they will collectively modify the spin of the projectile in a first direction. Similarly, if fin segments 61 are collectively deployed instead of fin segments 60, they will modify the spin of the projectile in an opposite direction. If the spin direction has been predetermined, then only two caging wires would be necessary, one for the particular fin segment to be deployed for spin modification and one for the central segment.

Figure 10:
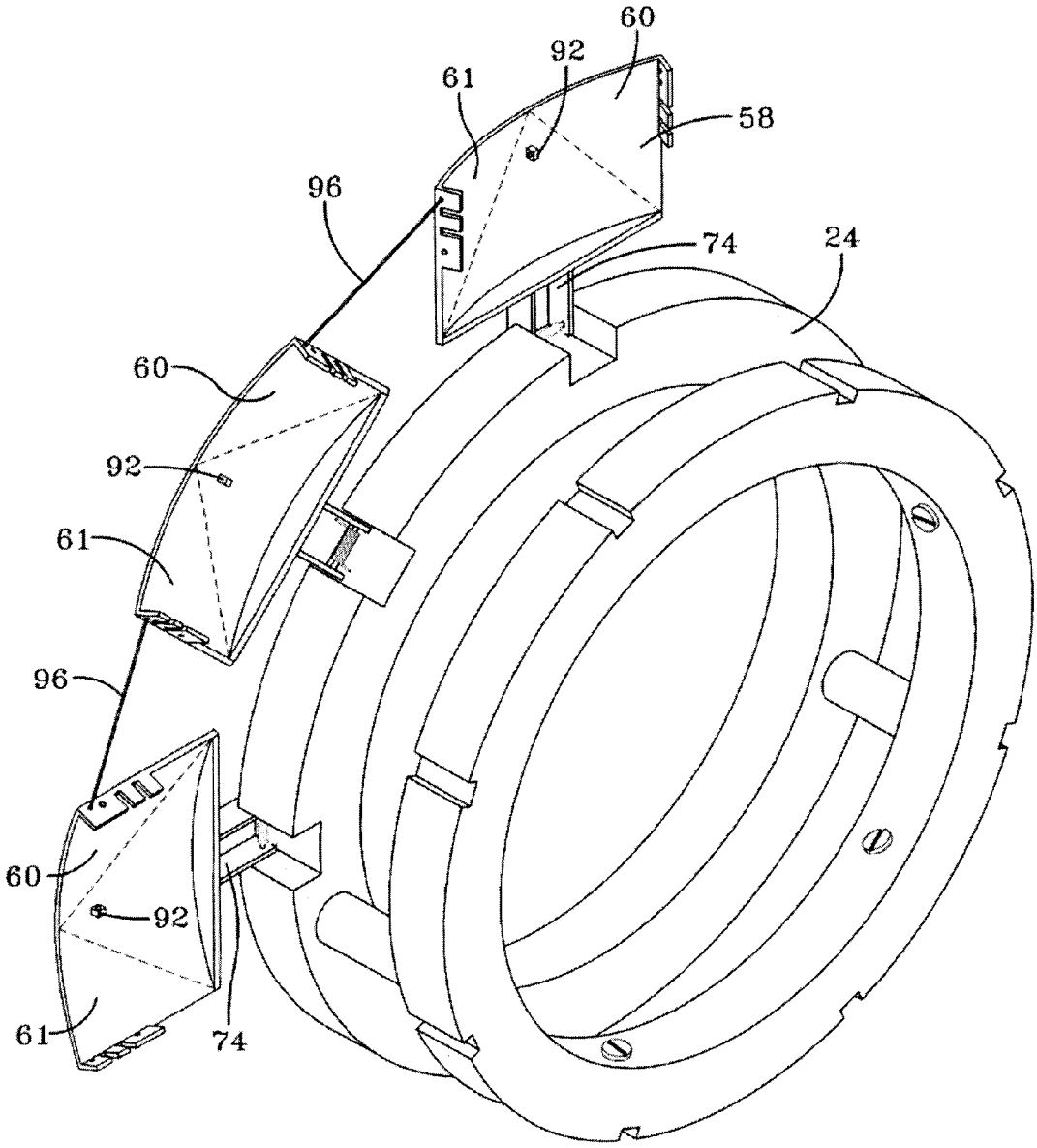
FIG. 10 illustrates fin deployment of the fins of FIG. 6 for braking action.

If a braking action is desired, either after a spin modification or in lieu of spin modification, then all caging wires 88, 89 and 90 of FIG. 7 are released, resulting in the full fin deployment illustrated in FIG. 10. Replacing the auxiliary fins 19 of FIG. 3 are the connecting wires 96 of FIG. 10 serving to evenly distribute the aerodynamic loads encountered in flight and to limit rearward movement of the segments as in FIG. 9 or the fins as in FIG. 10.

Figure 11:
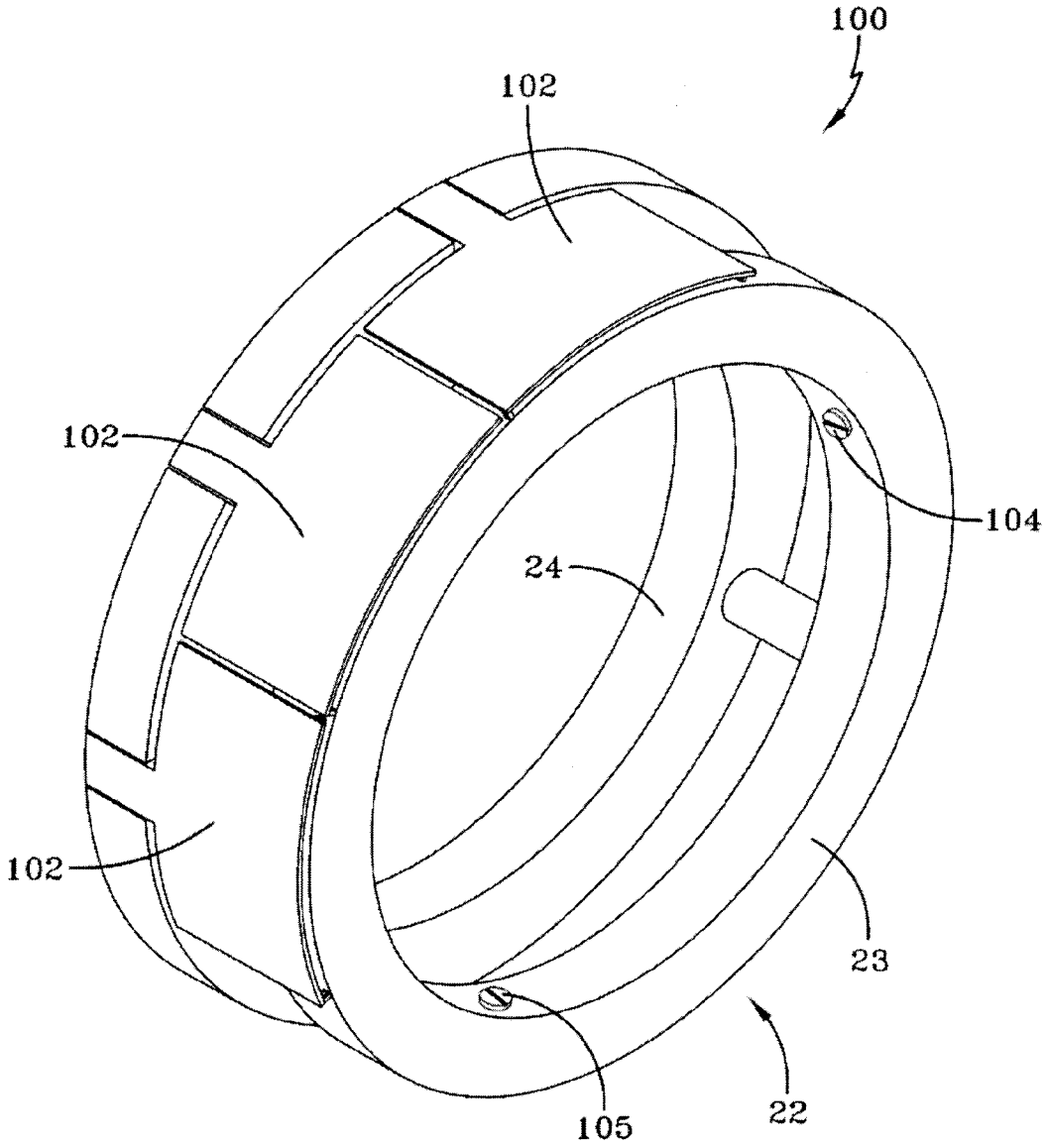
FIG. 11 illustrates another spin modulation and braking embodiment with fins in a closed condition.
Figure 12:
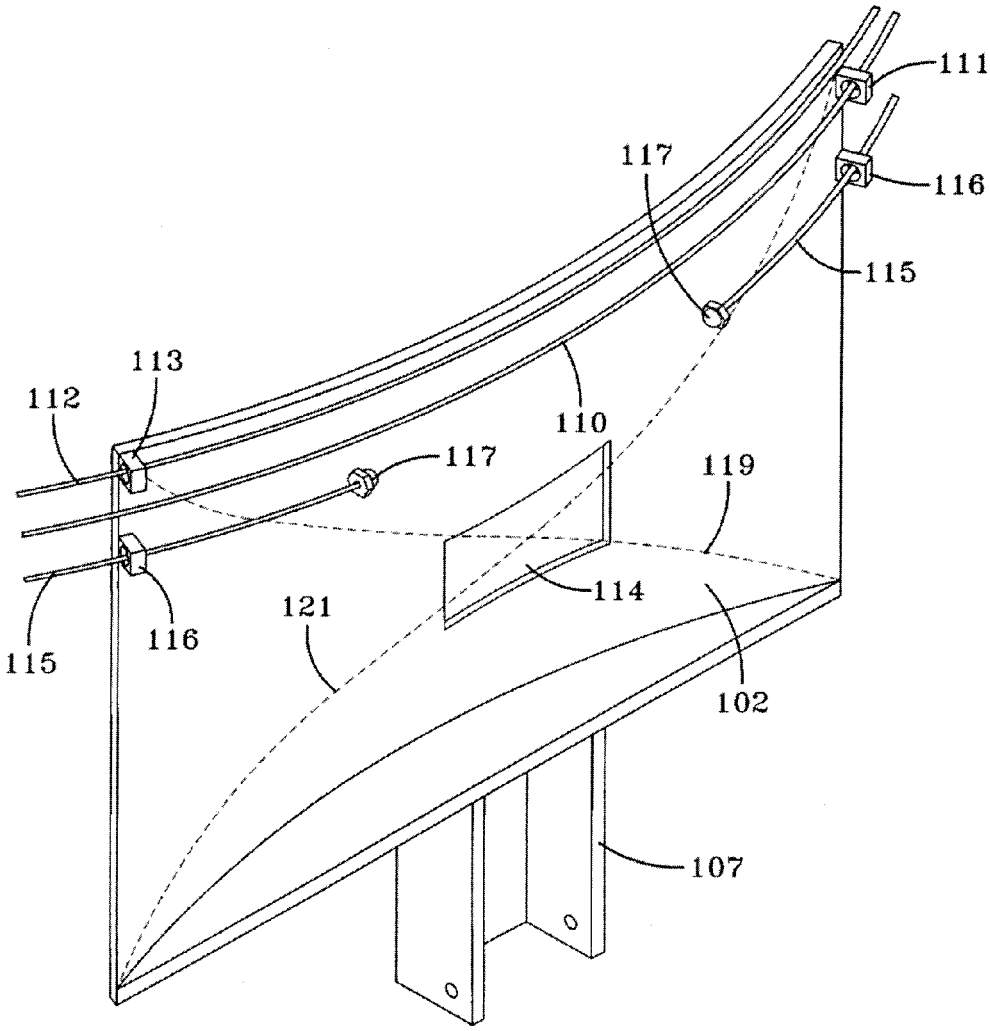
FIG. 12 illustrates a fin of FIG. 11 in more detail

FIG. 11 illustrates another form 100 of the spin and braking embodiment of the flight altering apparatus which provides a greater spin torque. This form of the embodiment, utilizing fins 102, functions as does the embodiment of FIG. 6, using two caging wires connected to respective tightening bolts 104 and 105. The fins 102 are monolithic foils as shown in FIG. 12 and include an aft tab 107 for pivoting about aft ring 24. The surface of the fin is of a preshaped spring material, or with the addition of a preshaped leaf spring (not illustrated) as in FIG. 7, to form a generally concave surface, between the fin edges, toward the forward end. Caging wire 110, passing through apertured stub 111, and caging wire 112, passing through apertured stub 113 will hold the front end of all of the fins 102 tightly against forward ring 23 in an orientation essentially conforming to the frame member, until a desired deployment. A thinned out area 114 facilitates the deployment along hinge lines 119 or 121 when either caging wire 110 or 112 is released. The coupling wires 115 pass through respective apertures stubs 116 and include stop members 117 at the ends thereof.

Figure 13:
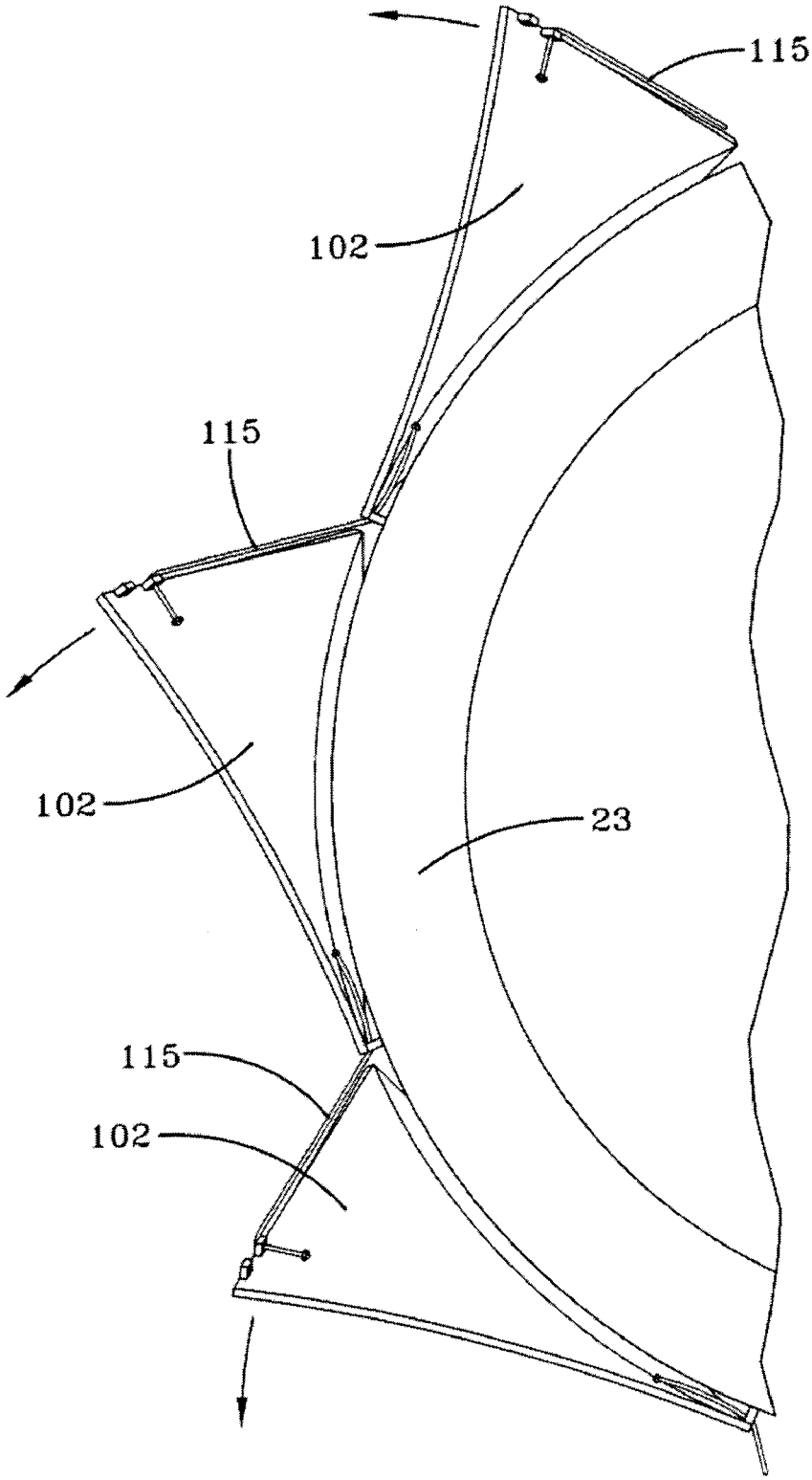
FIG. 13 illustrates fins, as in FIG. 11, in a spin modifying condition.
Figure 14:
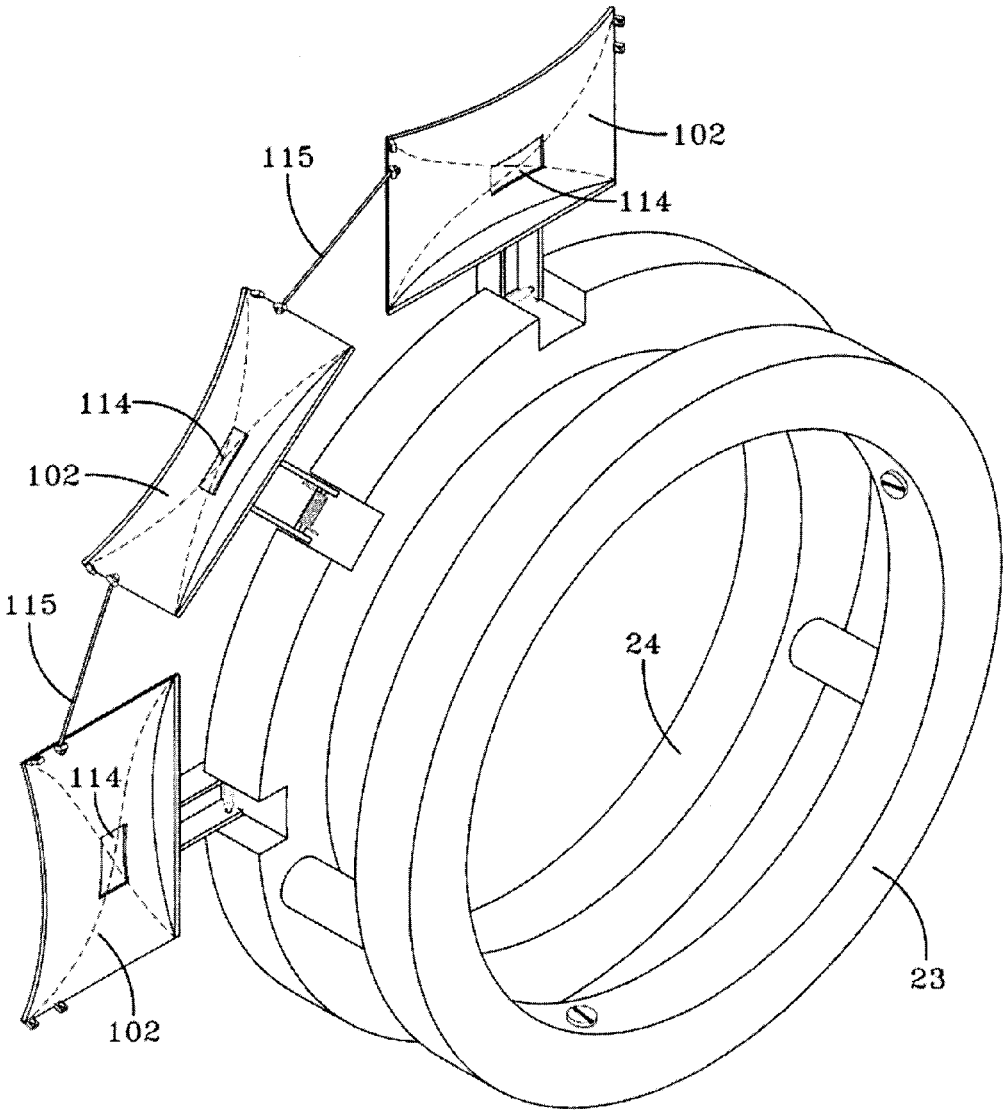
FIG. 14 illustrates fins, as in FIG. 11, in a braking condition.

For example, if a spin modification is desired similar to that resulting from the fin deployment in FIG. 9, then caging wire 110 is released allowing the edge of fin 102 to pop up to its uncaged original concave shape. This deployment is shown in FIG. 13, which also includes the coupling wire 115, connecting adjacent fins. For an opposite spin modification, caging wire 112 would be released, with caging wire 110 intact, and if a braking action is desired, both caging wires 110 and 112 would be released resulting in the fin orientation illustrated in FIG. 14.

Figure 15:
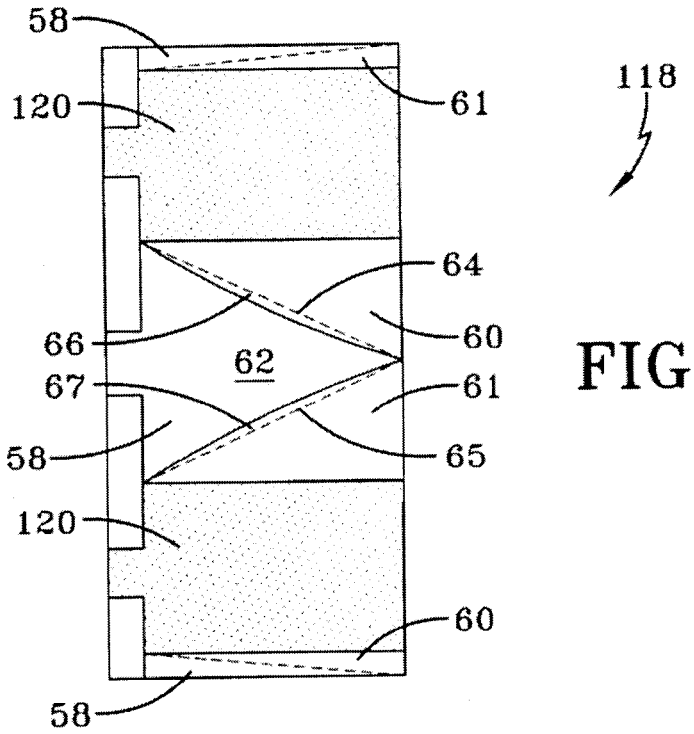
FIG. 15 is a side view of a deflecting and braking embodiment.
Figure 16:
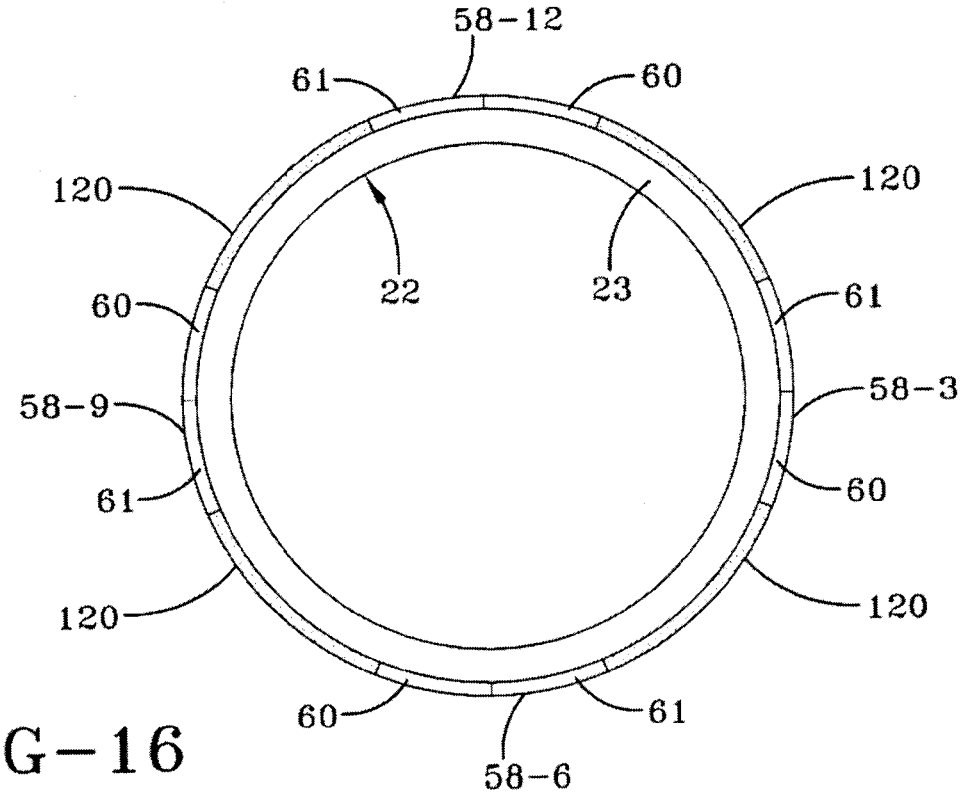
FIG. 16 is a front view of the embodiment of FIG. 15.

FIGS. 15 through 20 illustrate a simplified presentation of the projectile deflection embodiment 118 of the invention used for modifying the flight of non-spinning projectiles, such as a mortar round or missile. FIG. 15 illustrates a side view and FIG. 16 illustrates a front view. Fins 58, described with respect to FIGS. 6 through 10, are disposed about the frame member 22 at the 3 o'clock, 6 o'clock, 9 o'clock and 12 o'clock positions, and in FIG. 16 are designated as 58-3, 58-6, 58-9 and 58-12, respectively. Thus, two of the fins 58 are diametrically opposed along a vertical line and the other two fins 58 are diametrically opposed along a horizontal line. If the potential for a full braking action is desired, fins 120 (shown shaded) may be added.

Six caging wires (not illustrated) are used to deploy selected fin segments and fins. A first caging wire connects fin segment 60 of fin 58-12 to fin segment 61 of fin 58-6. A second connects fin segment 61 of fin 58-12 to fin segment 60 of fin 58-6. A third connects fin segment 61 of fin 58-3 to fin segment 60 of fin 58-9. A fourth connects fin segment 60 of fin 58-3 to fin segment 61 of fin 56-9. A fifth connects all central segments of fins 58, and a sixth connects all of fins 120. The fifth caging wire may be eliminated by connecting the central segments 62 with all the fins 120.

Figure 17:
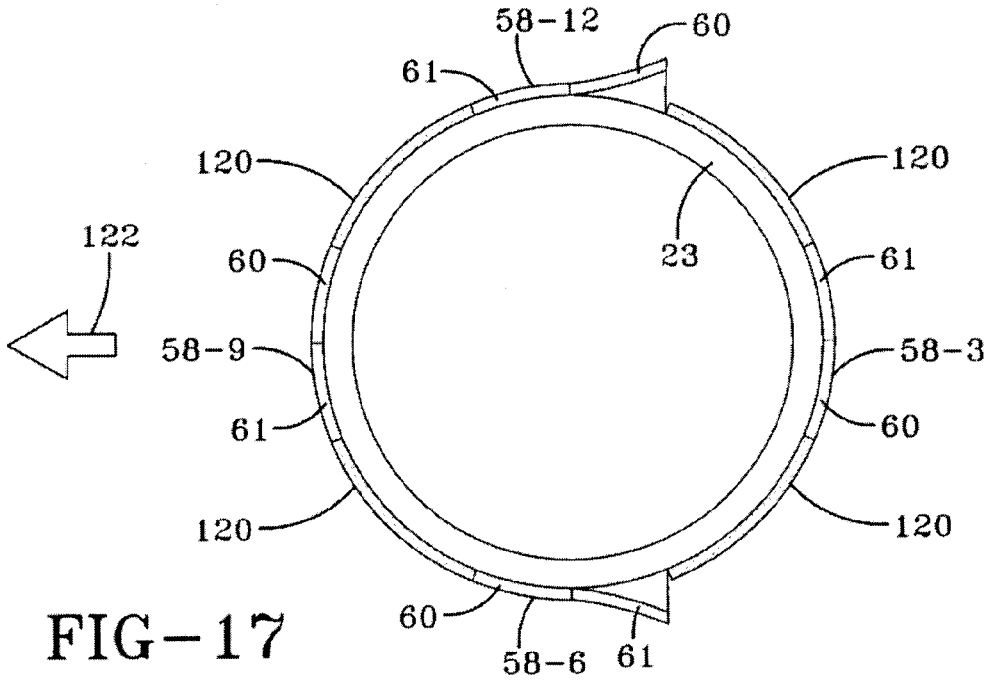
FIGS. 17 and 18 illustrate fin segment deployment to deflect or lift projectile trajectory.

FIG. 17 illustrates a deployment of fin segment 60 of fin 58-12 and fin segment 61 of fin 58-6 at their forward ends. The resulting aerodynamic forces on the area exposed on the deployed segments cause the round to veer from its path and move in the direction of arrow 122. Movement in an opposite direction may be achieved by deploying fin segment 61 of fin 58-12 and fin segment 60 of fin 58-6 instead.

Figure 18:
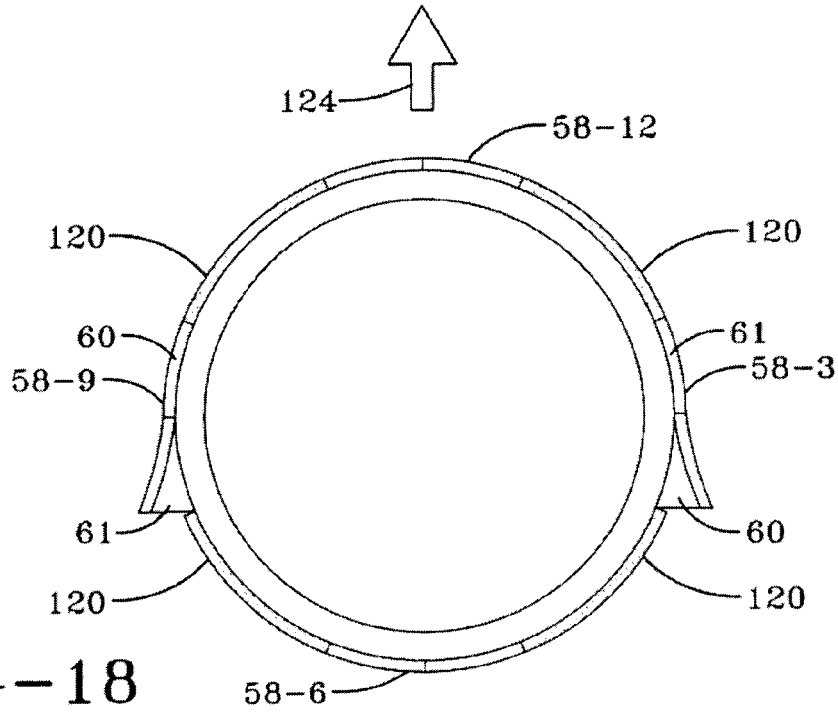

In a similar fashion, and as indicated in FIG. 18, deployment of fin segment 60 of fin 58-3 and fin segment 61 of fin 58-9 will cause the round to move upward in the direction of arrow 124. A downward movement would result with the deployment of fin segment 61 of fin 58-3 and fin segment 60 of fin 58-9.

Figure 19:
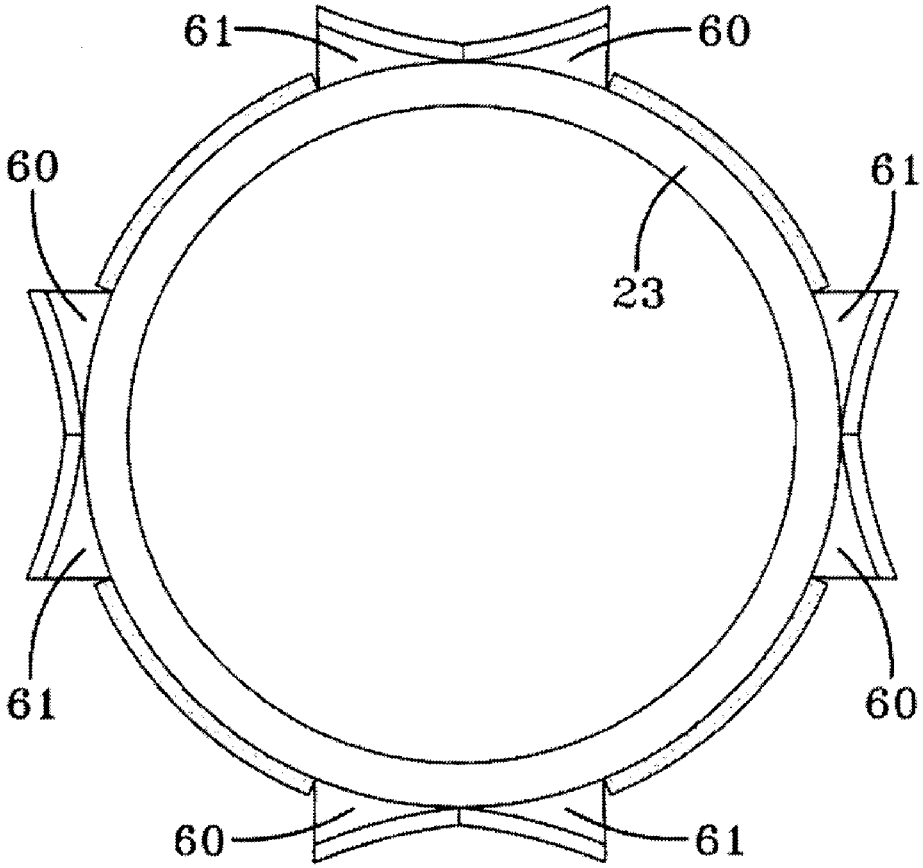
FIG. 19 illustrates a fin segment deployment to terminate the deflection or lift and provide for partial braking.
Figure 20:
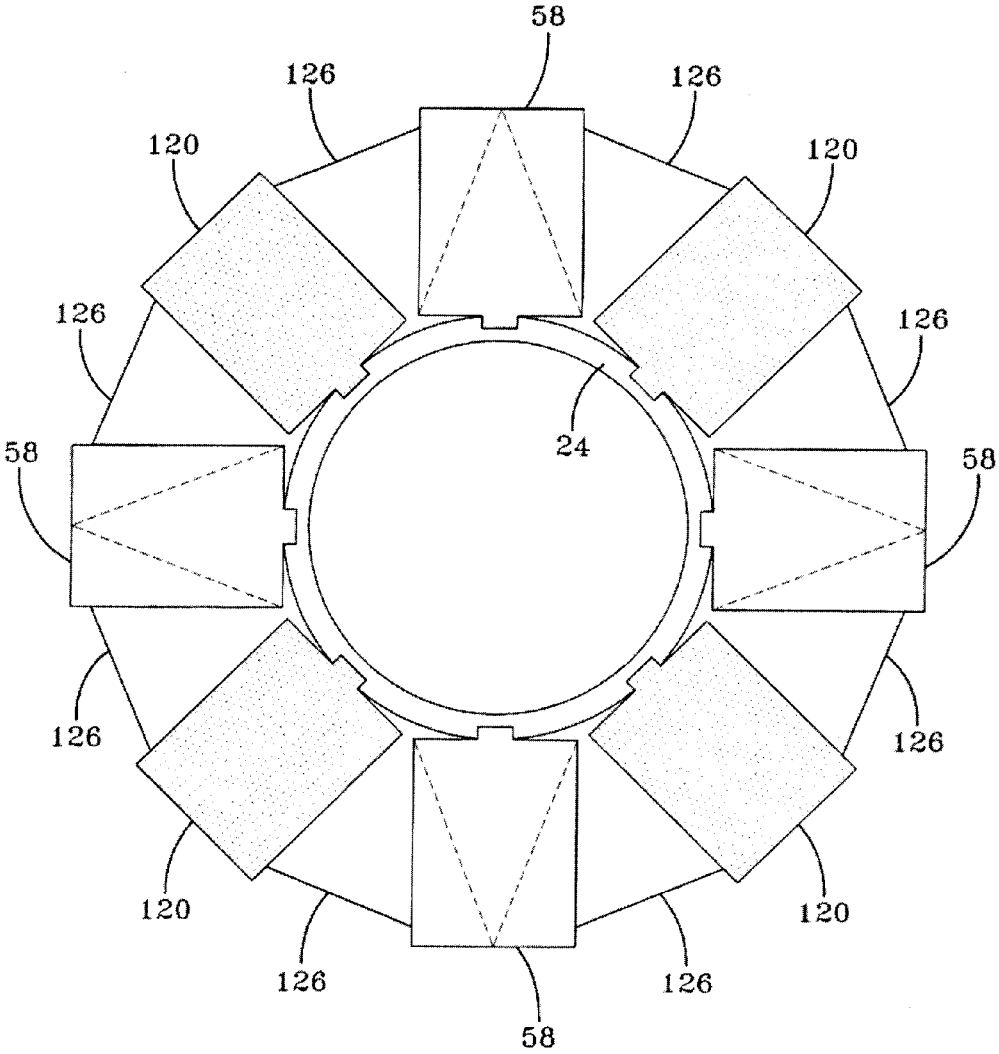
FIG. 20 illustrates the arrangement of FIG. 15 in a full braking mode of deployment.

Partial braking may be achieved by deploying all fin segments 60 and 61, as in FIG. 19, which will also terminate horizontal or vertical modification, as in FIGS. 17 and 18. Full braking may be achieved, as indicated in FIG. 20 by deploying all fins 58 as well as all fins 120. FIG. 20 also shows the coupling means in the form of wires 126 connecting adjacent fins to distribute aerodynamic loads.

It will be readily seen by one of ordinary skill in the art that the present invention fulfills all of the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be preferred embodiments of the present invention, it should be noted that the same has been made by way of illustration and not limitation. Accordingly, all modifications, alterations and changes coming within the spirit and scope of the present invention are herein meant to be included.

What is claimed is:

1. A flight altering apparatus for a projectile, comprising:
a frame member;
a plurality of fins each connected to said frame member by a pivot and surrounding said projectile, said plurality of fins further comprising:
a plurality of main fins; and
a plurality of auxiliary fins, each connected to two adjacent ones of said main fins to present a total fin surface to the airflow, when deployed, which is continuous and extends 360° around said projectile without any voids, so as to provide for maximum braking action;
a caging arrangement to maintain said fins in a stowed condition and operable, when activated, to allow deployment of said fins;
coupling means connected adjacent ones of said fins to evenly reduce and distribute aerodynamic loads on said fins and pivots when deployed during flight of said projectile; and wherein:
each said main fin includes side flanges;
each said side flange includes a slot;
each said auxiliary fin includes side flanges;
each said side flange of said auxiliary fin fitting through said slot in said side flange of an adjacent one of said main fins.

2. A flight altering apparatus for a projectile, comprising:
a frame member;
a plurality of fins each connected to said frame member by a pivot and surrounding said projectile;
a caging arrangement to maintain said fins in a stowed condition and operable, when activated, to allow deployment of said fins;
coupling means connected adjacent ones of said fins to evenly reduce and distribute aerodynamic loads on said fins and pivots when deployed during flight of said projectile; and wherein:
each said fin has a triangular central segment and first and second triangular fin segments contiguous with said triangular central segment and pivotable about said central segment along first and second hinge lines.

3. Apparatus according to claim 2 wherein:
said caging arrangement includes a first wire connected to all said first fin segments and a second wire connected to all said second fin segments for independently deploying said first fin segments and said second fin segments.

4. Apparatus according to claim 3 wherein:
said caging arrangement additionally includes a third wire connected to all said central segments.

5. Apparatus according to claim 2 wherein:
said coupling means is a wire connecting adjacent ones of said fins.

6. Apparatus according to claim 3 which includes:
a spring member attached to an end of said fin to assist in deployment of said first fin segment or said second fin segment.

7. Apparatus according to claim 2 which includes
a plurality of spring members, each connected to a fin for assisting in the deployment of said fin after said caging arrangement is activated to allow deployment of said fins.

8. Apparatus according to claim 2 wherein:
said frame is circular;
four of said fins are provided on said frame, two of said fins being diametrically opposed along a vertical line and the other two of said fins being diametrically opposed along a horizontal line;

said caging arrangement being operable to selectively deploy predetermined combinations of said fin segments.

9. Apparatus according to claim 8 which includes:

a plurality of other fins disposed on said frame between said fins between said fins with said fin segments; and said coupling means is a wire connecting adjacent ones of said fins.

10. A flight altering apparatus for a projectile, comprising:

a frame member;

a plurality of fins each connected to said frame member by a pivot and surrounding said projectile;

a caging arrangement to maintain said fins in a stowed condition and operable, when activated, to allow deployment of said fins;

coupling means connected adjacent ones of said fins to evenly reduce and distribute aerodynamic loads on said fins and pivots when deployed during flight of said projectile; and wherein:

each said fin has first and second edges and a performed concave surface between said edges, adjacent an end thereof;

said caging arrangement is operable to deform said fin to a convex orientation which is essentially conformal to said frame member;

said caging arrangement being operable, when activated, to performed condition; and said coupling means is a wire connecting adjacent ones of said fins.

11. Apparatus according to claim 10 which includes:

a plurality of spring members, each connected to a fin for assisting in the deployment of said fin after said caging arrangement is activated to allow deployment of said fins.

* * * * *